US007294095B2

(12) United States Patent
Charnitski

(10) Patent No.: US 7,294,095 B2
(45) Date of Patent: Nov. 13, 2007

(54) VIBRATING DEVICE FOR EXERCISE EQUIPMENT

(76) Inventor: Richard Charnitski, 25601 Adriana St., Mission Viejo, CA (US) 92691

( * ) Notice: Subject to any disclaimer, the term of this patent is extended or adjusted under 35 U.S.C. 154(b) by 107 days.

(21) Appl. No.: 10/838,917

(22) Filed: May 4, 2004

(65) Prior Publication Data

US 2005/0250626 A1 Nov. 10, 2005

(51) Int. Cl.
*A63B 21/002* (2006.01)

(52) U.S. Cl. ..... 482/91; 482/120

(58) Field of Classification Search ..... 482/148, 482/51, 52, 95–98, 99, 102, 120
See application file for complete search history.

(56) References Cited

U.S. PATENT DOCUMENTS

| | | | | |
|---|---|---|---|---|
| 3,851,874 | A | 12/1974 | Wilkin | 272/81 |
| 4,256,302 | A | 3/1981 | Keiser et al. | 272/118 |
| 4,328,965 | A | 5/1982 | Hatfield | 272/137 |
| 4,541,628 | A | 9/1985 | Parviainen | 272/134 |
| 4,606,540 | A | 8/1986 | Chin-Sen | 272/118 |
| 4,643,420 | A | 2/1987 | Riley et al. | 272/140 |
| 4,989,861 | A | 2/1991 | Halpem | 272/129 |
| 5,037,089 | A | 8/1991 | Spagnuolo et al. | 272/134 |
| 5,064,191 | A | 11/1991 | Johnson | 272/117 |
| 5,104,121 | A * | 4/1992 | Webb | 482/137 |
| 5,267,930 | A | 12/1993 | Henes | 482/139 |
| 5,496,238 | A | 3/1996 | Taylor | 482/63 |
| 5,647,825 | A | 7/1997 | Adkins et al. | 482/96 |
| 5,679,100 | A | 10/1997 | Chamitski | 482/51 |
| 6,027,429 | A | 2/2000 | Daniels | 482/5 |
| 6,217,491 | B1 | 4/2001 | Schiessl | 482/92 |
| 6,283,899 | B1 | 9/2001 | Chamitski | 482/110 |
| 6,413,196 | B1 | 7/2002 | Crowson | 482/118 |
| 6,436,006 | B1 | 8/2002 | Zemlyakov et al. | 482/51 |
| 6,659,918 | B2 | 12/2003 | Schiessl | 482/92 |
| 6,761,665 | B2 * | 7/2004 | Nguyen | 482/51 |
| 6,926,649 | B2 * | 8/2005 | Slawinski | 482/104 |
| 2004/0204293 | A1 * | 10/2004 | Andreasen | 482/52 |

OTHER PUBLICATIONS

Belarusian Informatics Centre BeIAC Unesco et al. *A Method Of the Natural Biological Activity Stimulation (Bas) of Human Body*, Republic of Belarus: published by BCI BeIAC UNESCO, 1993.

Cardinale et al. "Electromyograpgy Activity of Vastus Lateralis Muscle During Whole-Body Vibration of Different Frequencies." *Journal of Strength and Conditioning Research* 17(3) (2003): 621-624.

* cited by examiner

*Primary Examiner*—Lori Amerson
(74) *Attorney, Agent, or Firm*—Stetina Brunda Garred & Brucker

(57) ABSTRACT

An exercising device has a flexible tension member connected to a user interface that is connected to a mechanism for generating a resistive force which is overcome by the user moving the user interface to obtain exercise. The exercising device has a driving member rotating about a first axis and a circular oscillating surface rotatably connected to the driving member to circle about the first axis while also rotating about a second substantially parallel axis through the center of the circular oscillating surface. The first and second axes are offset a distance d. The flexible member wraps at least part way around the circular oscillating surface to rotate the oscillating surface as the user interface moves during use of the exercise device. The offset d provides an oscillatory motion to the user interface to increase the effectiveness of the exercise.

66 Claims, 11 Drawing Sheets

VIBRATING DEVICE FOR EXERCISE EQUIPMENT

BACKGROUND OF THE INVENTION

This application relates to vibrating exercise devices.

Exercise devices are known which cause a user's muscles to travel between two positions during which the user's muscles expand and contract. The resistance is typically provided by the effect of gravity on weights, or by a spring resistance or motors. Beginning in the 1980's Russian patents began to disclose vibrating platforms on which a person stood during exercise, with the vibrating platform superimposing a vibration that caused the user's muscles to expand and contract short distances arising from the vibration while simultaneously undergoing the longer expansion and contraction arising from the normal exercise. But these vibrating platforms require lifting the entire weight of the user, thus requiring heavier equipment and stronger motors causing the vibration. There is thus a need for a simpler way to provide a vibrational force directly to a more specific muscle or muscle groups to a person while exercising.

Further, a vibrating platform shakes the entire person, including the joints and muscles not undergoing the longer expansion and contraction. Shaking an entire person is undesirable. The prior art has devised various ways to use a vibrating platform and help reduce shaking an entire person, but the resulting apparatus is complex and heavy. There is thus a need for a simpler way to provide a vibrational resistive load to selected muscles of a person who is exercising.

SUMMARY

Briefly described, an oscillating pulley is provided that rotates about its own axis as it encircles another axis, with a motor driving the rotation about both axes, and with a flexible tension member, such as a rope, causing the pulley to further rotate about one axis.

In one embodiment there is advantageously provided an exercise exercising device for a user. The exercise device has a flexible tension member connected to a user interface that in turn is connected to a mechanism for generating a resistive force which is overcome by the user moving the user interface to obtain exercise. The device has a circular oscillating surface circling about a first axis and rotating about a second axis substantially parallel to the first axis, with the second axis passing through a center of the oscillating surface. A structural part rotates about the first axis and connects to the oscillating surface to constrain the oscillating surface to circle about the first axis. The first and second axes are offset a distance d selected to achieve the desired amount of oscillation or vibration. The flexible member wraps at least part way around the circular oscillating surface to rotate the oscillating surface about the second axis as the user interface moves during use of the exercise device.

In further variations of these embodiments the oscillating surface can take the form of a sprocket driving a chain or a belt. But the preferred version uses a pulley engaging a rope or cable. Another variation has the circular oscillating surface encircling the first axis, and if so a bearing is advantageously, but optionally interposed between the oscillating surface the first and second axes to facilitate relative rotational rotation of the oscillating surface about one of the first and second axes.

In further variations the flexible tension member can form a continuous loop. This can be used in rotational or reciprocating exercise devices. In one variation the continuous loop includes having opposing ends of the tension member each connected to a first end of a bar, with the bar having a user interface thereon. This configuration is particularly suitable for a climbing or total body climbing exercise device. The resistive device can include at least one weight urged by gravity to apply the resistive force to the flexible tension member, or it can comprise a hydraulic motor, a spring, an electric motor, a pneumatic motor, frictional resistance or various other known exercise-resistance mechanisms.

In still further variations one or more pulleys engage the flexible tension member and the tension member wraps at least part way around each pulley. The pulleys can change the orientation of the flexible tension member and thus allow various orientations for the user interface (e.g., a handle or bar). The amount of vibration can be varied by adjusting the motor, or by adjusting the amount which the flexible tension member wraps around the oscillating surface. The flexible member can connect to a releasable fastener inserted into one of a plurality of apertures to vary the amount the flexible member wraps around the circular surface.

Advantageously, but optionally the axes are offset a distance d that is less than about 0.5 inches, preferably about 0.1 to 0.3 inches, and ideally about 0.15 inches. A resilient member can be interposed between the flexible tension member and the user interface to reduce the vibrational effect, and that is especially useful for physical therapy applications. The motor advantageously rotates the oscillating surface at a speed of below about 100 Hz, although higher speeds could be used if desired.

A further embodiment provides an exercising device having means for rotating a circular oscillating surface about two substantially parallel axes which are offset a distance d. This embodiment also includes a flexible tension member having a first end connected to the resistive force mechanism and a second end connected to the user interface. The flexible tension member wraps partway around the oscillating surface to rotate the oscillating surface about one of the axes during use of the exercise device.

Variations of this further embodiment include means for varying the amount the flexible member wraps around the circular oscillating surface. Advantageously the tension member wraps between 5 and 180° around the circular oscillating surface. The variations further include means for varying the offset distance d.

There is also provided a method for providing exercise to a user of an exercising device having a flexible tension member connected to a user interface that is connected to a mechanism for generating a resistive force which is overcome by the user to obtain exercise. The method includes wrapping a flexible tension member around part of a circular oscillating surface which is free to rotate about a central axis of that surface, and which is simultaneously rotated about another eccentric axis, causing the tension member to oscillate.

In more detail this method includes rotating a first part about a first axis and rotating a circular surface about the first axis and about a second axis through the center of the circular surface. The first and second axis offset by a distance d. The method includes wrapping the flexible member around part of the circular surface and moving the flexible member along that circular surface. The circular surface is rotated about the second axis as the circular surface circles around the first axis during use of the exercise device to cause oscillatory motion in the flexible tension member. Variations on this method include the method counterparts of the above described variations on the apparatus, and further variations described herein.

In a most preferred embodiment there is provided a flexible tension member forming a continuous loop which encircles a driving surface on a sprocket that rotated about two axes to cause the sprocket and tension member to oscillate. At least one, and preferably two hand grips are fastened to the tension member. At least one, and preferably foot rests are also fastened to the tension member, one below hand grip, with the loop being generally vertically oriented to form a climbing exercise device. A tension pulley can optionally engage the tension member to maintain the tension in the member, and advantageously a tension sprocket is used as the tension member advantageously comprises a chain. Most preferably, the tension member has two bars interposed in the continuous loop with the bars arranged substantially parallel, and the hand grips and foot rests fastened to the bars. A resistance device also engages the flexible tension member to provide resistance, while the oscillating driving surface provides vibrational or oscillating motion to the hand grips and foot rests. Resiliently mounting the motor to a frame of the exercise device helps isolate the vibration to the flexible tension member. More generally, interposing one of a vibration isolator or damper between the oscillating surface and a frame of the exercise device is preferably, but optionally used to reduce vibration of the frame.

BRIEF DESCRIPTION OF THE DRAWINGS

These and other advantages and features of the invention will be better appreciated in view of the following drawings and descriptions in which like numbers refer to like parts throughout, and in which.

DETAILED DESCRIPTION

Figure 1:
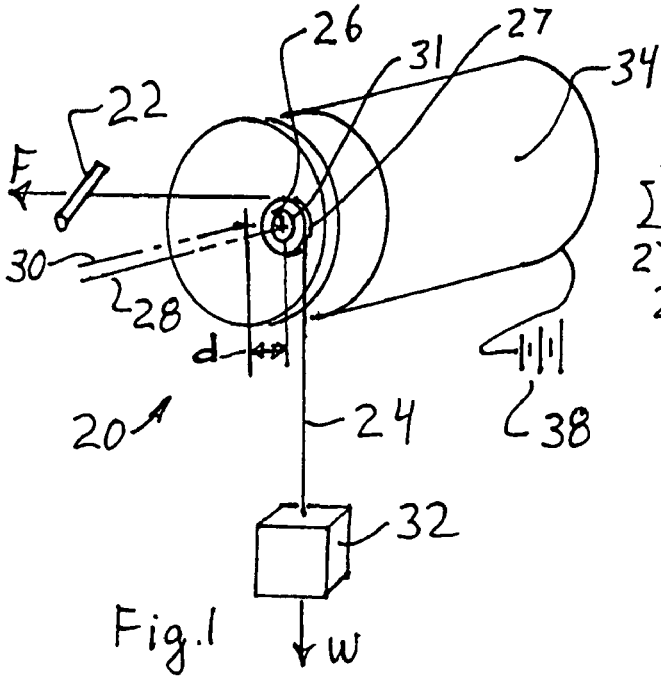
FIG. 1 is a perspective view of a first embodiment of a vibrating device with an offset drive mechanism for use with an exercise device.
Figure 2:
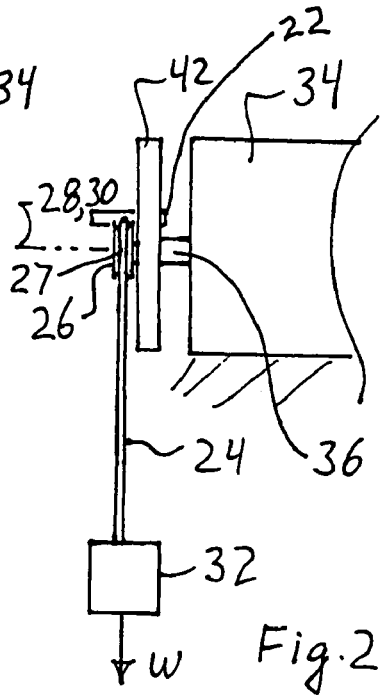
FIG. 2 is a partial side view of the vibrating device of FIG. 1.

Referring to FIGS. 1-2, an exercise device 20 is shown which has a user engaging device 22, which for ease of reference and without limiting the invention will be often referred to herein as a handle, although various engaging devices could be used. A person using the device 20 to exercise exerts a force F on the handle 22 using the person's legs, arms, torso, or other body part the muscles of which are to be exercised. The handle 22 is connected to a driven member 24. The driven member 24 advantageously, but optionally comprises a flexible tension member 24, such as a rope, wire, cable, chain or belt. For convenience the flexible tension member 24 will often be referred to as a cable, but is not limited to such.

Figure 6:
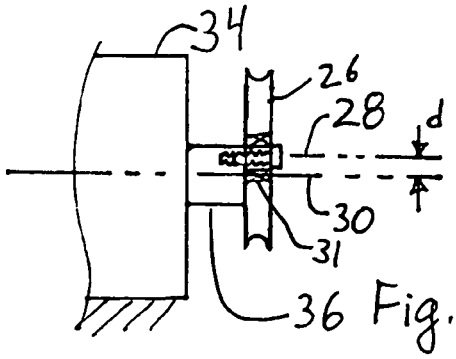
FIG. 6 is a partial sectional view of an embodiment for attaching an offset drive mechanism to a motor.

The cable 24 curves at least part way around a curved oscillating surface 26 eccentrically mounted oscillating surface 26. The oscillating surface 26 may take various forms, including sprockets, various pulleys, various belt drives and other rotational devices that have a surface, preferably but optionally circular, which is rotatably mounted as described herein and which engages the flexible tension member 24 along an engaged portion or driving surface 27. The driving surface 27 is along the length of engagement between the flexible tension member 24 and the oscillating surface 26. In the embodiment of FIG. 1 the oscillating surface 26 is advantageously, but optionally, a pulley and will be generally referred to as pulley 26 for ease of reference. The pulley 26 has an axis 28 at its center, and rotates about axis 28 in this embodiment. But axis 28 is offset a radial distance "d" from the rotational axis of the drive, such as motor 34, so the center of pulley 26 circles the drive axis 30. Advantageously, but optionally, the offset pulley 26 is mounted on a bearing surface 31 (FIGS. 6-7, 18), such as roller bearing, ball bearing or a bushing so it freely rotates, and is shown here rotating about the center axis 28 of the offset pulley 26. As used herein the offset pulley 26 rotates but for brevity that will not be repeated each time the pulley 26 is mentioned.

The cable 24 is connected to a force or resistance generating device 32, such as a spring, a weight, a friction gripping device, or a hydraulic or pneumatic or electrically actuated resistive device, or fluid damped torsional device, cables wrapped around pulleys, each of which engages the cable 24 to resist movement of the handle 22 and thus provide the user with exercise in overcoming the resistance. A weight W which gravity urges downward is shown in FIG. 1, but any resistance generating device known to one skilled in the art for use on an exercise device 20 could be used. For convenience, a weight W will typically be used for illustration but any resistance device could be used.

A motor 34 is drivingly connected to the drive axis 30 by various a drive coupling devices 36, which can comprise any known mechanism for connecting the motor to rotate the pulley, such as gears, chains, belts, linkages or drive shafts. The coupling device 36 is shown as a motor drive shaft in FIG. 1 with the shaft along axis 30 and is eccentrically located relative to the pulley 26 by a distance d. The motor 34 is mounted various ways and is shown is being mounted to an arbitrary ground. The motor 34 is typically mounted to a frame holding the pulley 26 and forming part of the exercise device 20, but it could be mounted otherwise.

When a user moves the handle 22 with force F, the resistance generating device (e.g., weight W) resists the movement of the handle, causing the user to flex and contract the muscles used to move the handle 22. When power from a power supply 38 drives the motor 34 the pulley 26 rotates about offset axis 28. The pulley 26 allows the cable 24 to move smoothly over the pulley drive surface 27, but the offset axis 28 causes the pulley to oscillate an amplitude or distance of 2*d*, and that oscillation causes a vibration in the cable 24 and handle 22. The user thus experiences not only the weight W, but a superimposed vibration equivalent to the movement of the weight W a distance 2*d*, at a frequency set by the rotational speed of the pulley 26. There is thus advantageously provided a means for providing a vibrational or oscillating force to a user interface 22, without using a platform and without having to shake the user's entire body.

The offset pulley 26 is configured to allow the pulley to rotate about offset axis 28 and thus roll along the engaged length of the cable 24 over drive surface 27 as the pulley rotates about the geometric center axis 30. The offset pulley 26 also allows the cable 26 to move along its length relative to the pulley 26, so that movement of handle 22 causes the cable to move across and rotate the offset pulley 26. If the pulley 26 were not rotatably mounted about its own axis, then as the pulley circled the axis 30 the cable 24 would slide on the circumference of the non-rotating pulley and either the non-rotating pulley, the length of cable sliding over the non-rotating pulley, or both, would quickly wear out.

Figure 7:
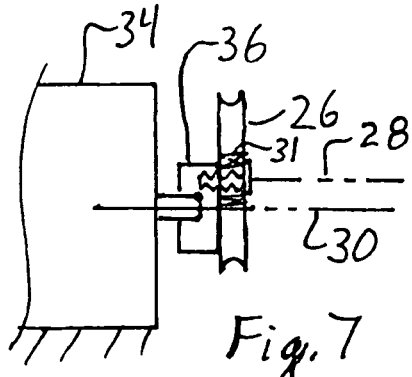
FIG. 7 is a partial sectional view of a further embodiment for attaching an offset drive to a motor.

The motor 34 advantageously has a fixed offset d on the rotating pulley 26. If the motor 34 has a large diameter shaft the offset pulley 26 can be fastened directly to the shaft or drive coupling 36 as in FIG. 6. If the shaft is too small for a sufficiently strong connection, then as shown in FIG. 7 a larger diameter coupling 36 can be fastened to the motor drive shaft, as by welding, pins, keys, threads, or other fastening mechanisms known to one skilled in the art. The larger coupling 36 allows eccentric mounting of the pulley 26 to the rotational source, and preferably directly to the drive shaft of the motor 34 rather than to a remotely driven shaft. The use of the larger coupling 36 can in some cases permit larger bearings 31 to be used on the rotational shaft of the offset pulley 26.

The axis 30 advantageously has an offset, preferably but optionally less than about 1 inch (2.5 cm), which causes an amplitude of about 2 inches (5 cm) on the handle 22. Larger amplitudes can be used. For most exercise situations maximum amplitudes of about ⅜ inch to 0.5 inches (about 100-130 mm). Typically, a maximum amplitude of about 0.2 inches (50 mm) is believed suitable, which could correlate to an offset of about 0.1 inch (25 mm). For some applications amplitudes of 0.1 inch (2.5 mm) are desirable which correlates to an offset of about 0.15 inches (about 38 mm). Various combinations of amplitude and frequency can be used. The offset d is intentionally induced, and does not include accidental offsets caused by assembly tolerances, which tolerances are typically less than about 0.01 inches, and preferably measured in thousandths of an inch.

A number of ways are known to those skilled in the art to vary the speed of motor 34 and thus vary the speed of pulley 26. For electric motors 34 which drive the pulley 26 variable speed motors are commercially available. Variable speeds can be achieved using a variable resistor, a voltage regulator, a current amplifier, or any of a variety of electrical circuits. If a hydraulic motor 34 is used then a pinch valve could be used to vary the fluid to the motor and thus vary the speed of rotation. Alternatively, a gear drive or fluid drive could be interposed between the motor 34 and the pulley 26, and used to vary the rotation of the eccentric pulley. Advantageously, but optionally, the selected control allows a user to turn a knob or press a button and select a desired rotation of the pulley 26, and to do so during use of the exercise device 20.

Figure 3:
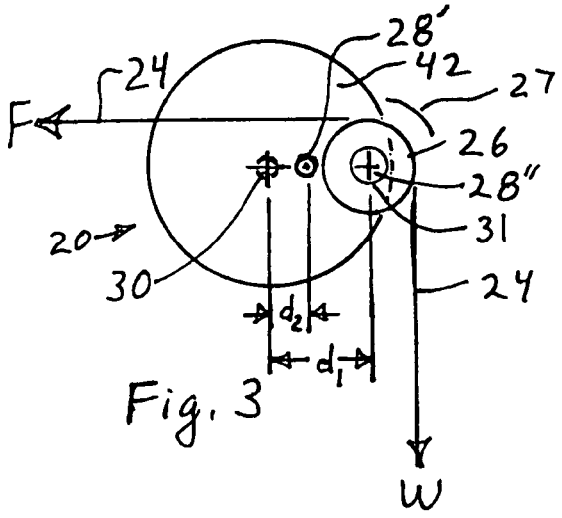
FIG. 3 is a front plan view of a further embodiment of the vibrating device of FIG. 1.

Referring to FIG. 3, preferably, but optionally, the amplitude of oscillation from the pulley 26 can also be varied. This could be achieved by mounting the pulley 26 to rotate at different offsets d selected by the user. This can be achieved various ways, but is shown in FIG. 3 by having a rotating part, such as disk 42 rotating concentrically with drive coupling 36 about axis 30. Fastening the disk 42 to rotate with the motor shaft 36 would achieve this. The pulley 26 is rotatably mounted to the rotating disk 42, but at any of a plurality of selected locations, such as rotating about axis 28" offset a distance $d_2$ from axis 30 or rotating at an offset a distance $d_1$. Other holes or connections for rotatably mounting the pulley 26, at different offsets such as $d_2$ can be provided on the disk 42. Threaded fasteners or pinned connections could be used to shift the pulley 26 from location to location. Indeed, one skilled in the art could devise numerous ways to movably mount the pulley 26 to the disk 42 given the disclosures herein. If desired, the disk 42 can also be configured to act as a flywheel to help counterbalance the force caused by the offset rotation and to help smooth out the forces and unbalances exerted about rotational axis 30.

Figure 4:
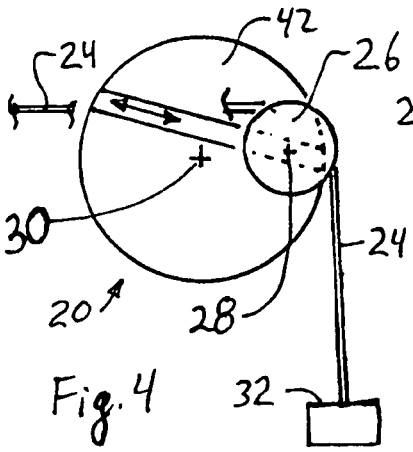
FIG. 4 is a front plan view of a further embodiment of the vibrating device of FIG. 1.
Figure 5:
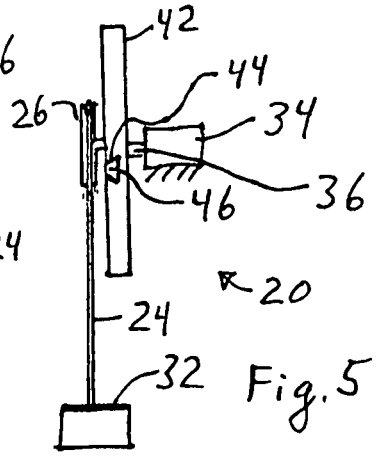
FIG. 5 is a side plan view of the vibrating device of FIG. 4.

Alternatively, referring to FIGS. 4-5, a rotating disk 42 can have a groove 44 containing a bar 46 slidable in the groove. When the pulley 26 is mounted to the bar 46, then movement of the bar along the groove can vary the offset. The groove 44 can run through the rotational axis 30, or it may be offset from the axis 30, and is shown offset. Fasteners (not shown) such as threaded fasteners or pins with detent mechanisms in the ends can be used to pin or fasten the bar relative to the disk 42. Again, one skilled in the art could devise numerous ways to movably mount the pulley 26 to the disk 42 given the disclosures herein. The groove 44 is advantageously but optionally wedge shaped or shaped otherwise so it does not pull out of the disk 42 easily along the rotational axis 30.

Figure 8:
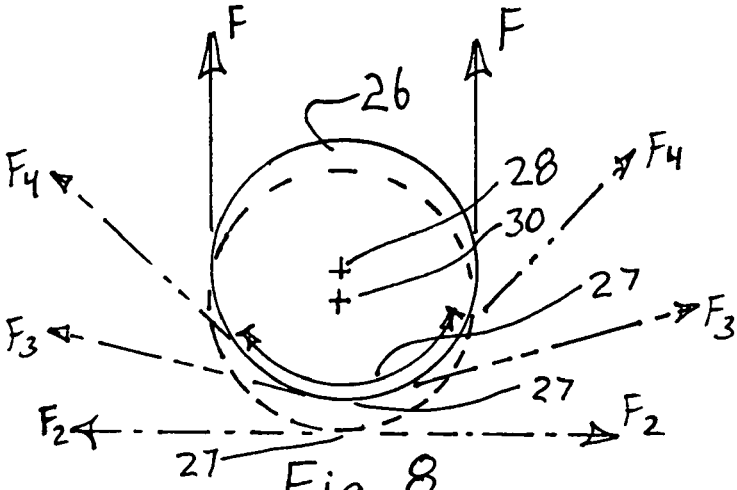
FIG. 8 is a front plan view of an offset drive mechanism showing force and displacement variations.

A further way to vary the amount of oscillation or vibration is shown in FIG. 8. The force provided offset pulley 26 with the fixed offset d is varied by altering the extent to which the cable 24 wraps around the pulley 26. If the cable 24 wraps around the offset pulley 26 about half a turn, or about 180°, then the maximum displacement d and corresponding force F is exerted on the cable 24, and handle 22, so the user experiences the maximum vibrational amplitude. But if the cable 24 is straight, or horizontal as shown in phantom in FIG. 8, and located so the cable just engages the periphery of pulley 26 at the maximum oscillation d, then the length of the engaged drive surface 27 is minimal and the vibrational force in the cable 24 is minimal, as denoted by $F_2$. In between these two extremes are a variety of positions such as $F_3$ and $F_4$ (shown in phantom) which vary the amplitude of vibration, and thus the force, exerted on cable 24, handle 22 and the user.

Note that as the cable 24 wraps further a round the pulley 26 it oscillates not only vertically, but horizontally as it travels in a circle about axis 30. The flexible tension member 24 does not transmit forces lateral to the axis of the tension member other than as a force component along the length of the tension member 24. It is inefficient to push on a rope. The use of the oscillating, rotating pulley 26 in combination with the flexible tension member 24 thus provides an efficient means for creating a primarily uniaxial oscillating force using a rotating eccentric. The use of one or more idler pulleys 50, 52 can eliminate even the lateral force component on the tension member 24.

Figure 9:
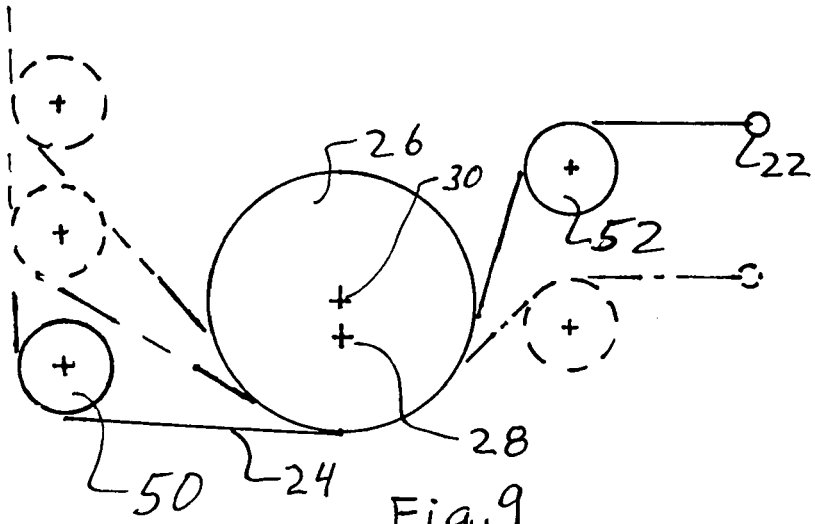
FIG. 9 is a front plan view of a mechanism for varying the force and displacement of an offset drive mechanism for use with the vibrating exercise device of FIG. 1.
Figure 10:
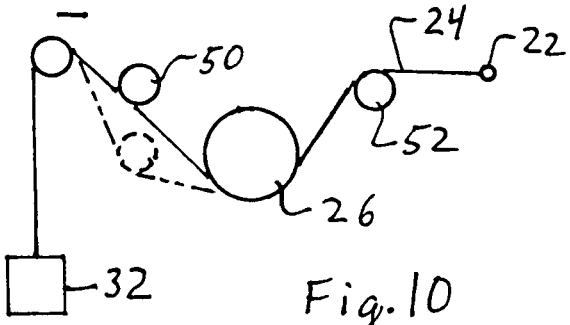
FIG. 10 is a front plan view showing a further embodiment of the mechanism of FIG. 9.
Figure 13:
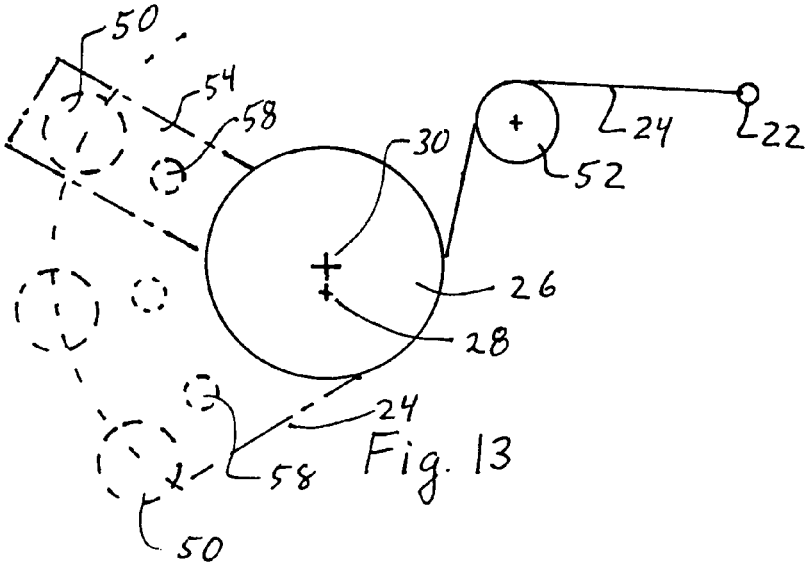
FIG. 13 is a further rotational embodiment of a mechanism to vary the force and displacement of the offset drive mechanism of FIG. 9.

Depending on the nature of the arrangement the adjustment of the engagement between the offset pulley 26 and cable 24 can be varied several ways. Referring to FIGS. 9-10, the offset pulley 26 is located between first and second idler pulleys 50, 52, respectively. Preferably, but optionally, one of the idler pulleys, preferably first idler pulley 50 is movably positionable to vary the engagement of cable 24 with the offset pulley 26. In the illustrated embodiment of FIG. 9 the idler pulley 50 is movable along a vertical axis but the axis could have other orientations. The offset pulley 26 could be similarly movable to vary the amount of engagement of cable 24 using one of the embodiments of FIGS. 3-5 or others. As shown in FIG. 13, the first idler pulley 50 (or pulley 52) could be rotatably mounted about an axis, preferably concentric with pulley axis 30 or rotational axis 28.

The second idler pulley 52 could be similarly positionable. Preferably, but optionally, the second idler puller 52 is stationary so that there is a consistent position of the cable 24 relative to the handle 22. It is believed suitable to eliminate one or the other or both of idler pulleys 50, 52. If idler pulley 52 is eliminated, then the amount of vibrational amplitude exerted on handle 22 by cable 24 will vary depending on how the user orientates the cable relative to the offset pulley 26. Depending on the desired orientation of the handle 22, it may be possible to eliminate all idler pulleys.

Figure 19:
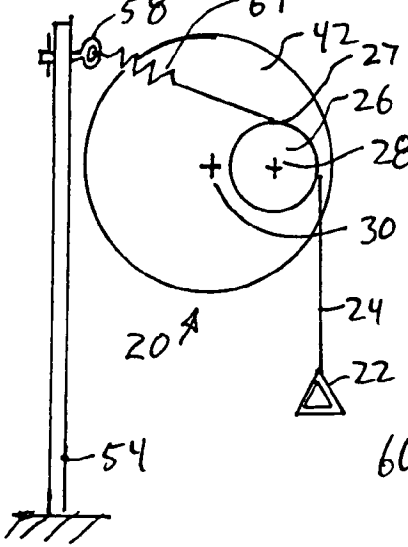
FIG. 19 is a plan view of a further embodiment of an exercise device of FIG. 1 having a resilient member connected to the handle.

FIG. 10 shows one way in which the two idler pulleys 50, 52 can be connected to the force generating device 32 while resisting movement of handle 22 to provide exercise to the user. Depending on the nature of the source generating device, the arrangement can vary, and various numbers of idler pulleys 50, 52 could be used. The pulleys 50, 52 could also be omitted. FIG. 19 shows the idler pulleys omitted, and provides an isometric exercise device 20. Positioning of the pulley 26 could vary the amount of vibration.

Further, the idler pulleys 50, 52 could either, or each, be resiliently or movably mounted to provide a tension mechanism to maintain a predetermined tightness in the flexible tension member 24. For example, one or more idler pulleys 50, 52 could act as tension pulleys by spring mounting one or more of them to move in a direction that maintains tension to the tension member 24 while allowing movement in the opposing direction to accommodate oscillation. A spring (e.g., spring 92 of FIG. 97) urging the pulley to move along a slot could achieve this, as could other mounting mechanisms known to one skilled in the art. A pivoted pulley resiliently urged (e.g., by a spring or spring-dashpot) to maintain the flexible tension member taut, could also be used.

Figure 11:
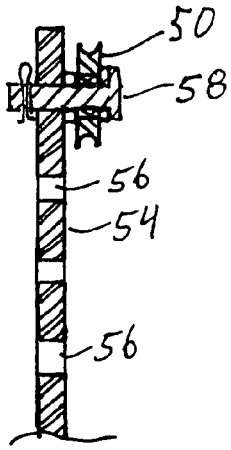
FIG. 11 is a sectional view of a mounting bracket showing an idler pulley removably fastened to the bracket for use with the mechanism of FIG. 9.
Figure 12:
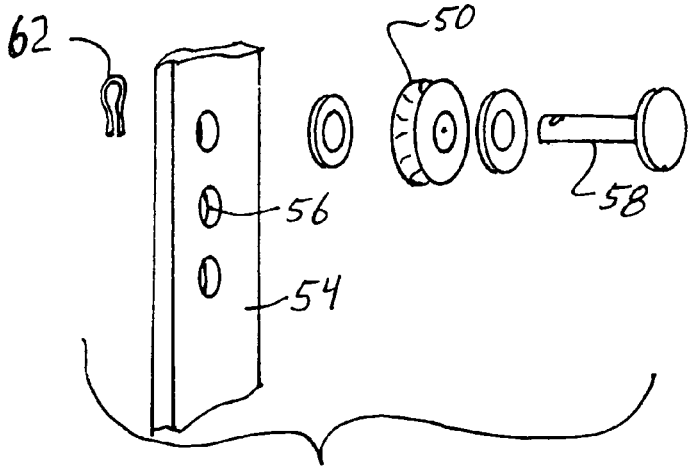
FIG. 12 is an exploded perspective view of the bracket of FIG. 11.

Referring to FIGS. 11-13, the details of one way of adjusting the position of the idler pulley 50, 52 is shown. A pulley mounting bracket 54 has one or more holes 56 through which removable fastener 58 extends. The fastener 58 extends through a hole along the rotational axis of the idler pulley 50 and any bearing or bushing within the pulley. A removable lock 62 holds the fastener 58 in position. A cotter pin 62 extending through a hole in the distal of the fastener 58 is shown. Various removable and lockable fasteners and locks can be used, including threaded devices such as nuts and bolts, pins with resilient detents in the distal ends, expandable bushings, and other removable locking mechanisms known to those skilled in the art. The lock 62 is optional, but advantageous.

FIG. 13 shows a rotationally mounted bracket 54, with the fastener 58 fitting into holes arranged on a circle concentric with the rotational axis of the bracket. Advantageously the bracket 54 pivots about axis 30 or rotational axis 28 to the desired position where it is then locked into position by a fastener similar to fastener 58. One skilled in the art could devise numerous variations on the fastener 58 and lock 62 given the disclosures herein.

Figure 14:
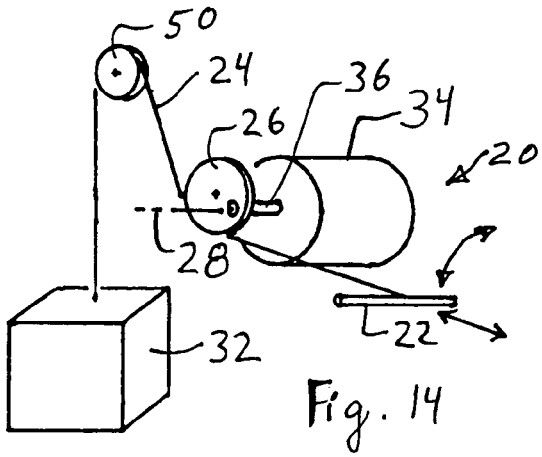
FIG. 14 is a perspective view of a further embodiment of a vibrating exercise device.
Figure 15:
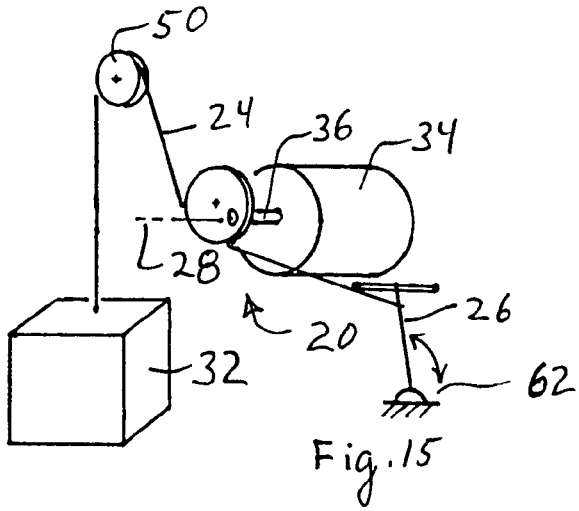
FIG. 15 is a perspective view of a further embodiment of a vibrating exercise device.
Figure 16:
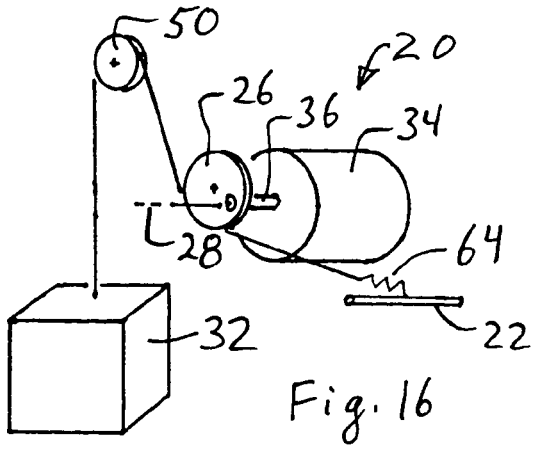
FIG. 16 is a perspective view of a further embodiment of a vibrating exercise device.

Referring to FIGS. 14-16, various alternative ways of using the offset pulley are shown, but these are not exhaustive. The figures show only one idler pulley 52, but more, or fewer could be used as discussed above. In FIG. 14 the user engaging device 22 is a handle as can be used for curls and various other pulling exercises.

FIG. 15 shows the engaging device as comprising a handle constrained to move about a predefined path 62, which is illustrated as rotating about a pivot point. This arrangement could be adapted for use on rowing machines by using a cam track as the predefined path 62 instead of a pivot point.

FIG. 16 shows a resilient member 64 interposed between the cable 24 and user engaging device 22. An extension member such as a bungee cord or elongated spring is believed suitable. By varying the stiffness of the resilient member 64 the vibrational effect on the engaging device 22 can be significantly lowered. The resilient member 64 can advantageously be used in physical therapy and rehabilitation exercises.

Figure 17:
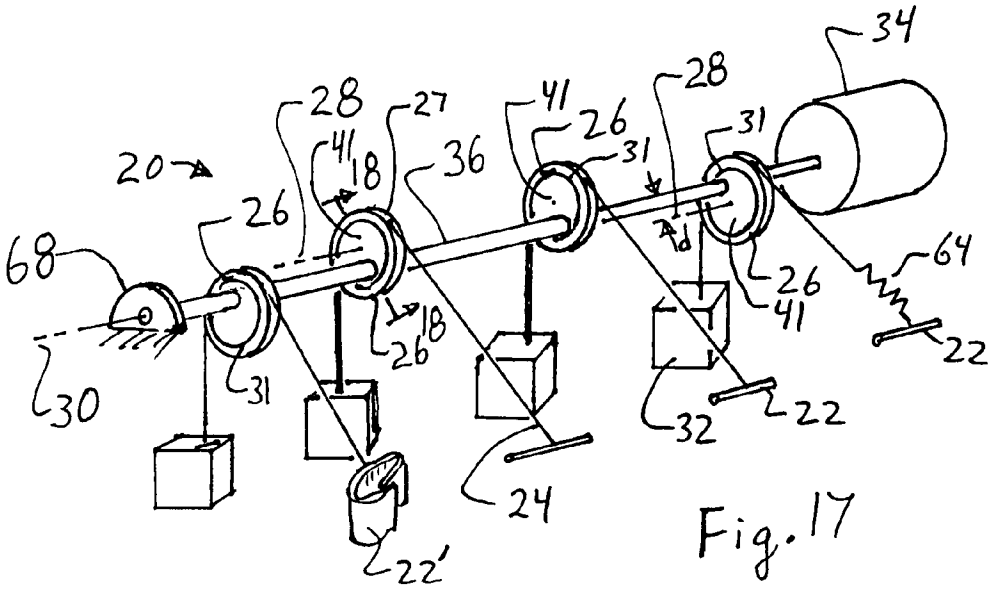
FIG. 17 is a perspective view of a further embodiment of a vibrating exercise device having multiple user interfaces.

Referring to FIG. 17, more than one offset pulley 26 can be rotated by a single drive source such as motor 34, by having an elongated shaft form the drive coupling to the motor. When multiple offset pulleys 26 are rotated by a common shaft 36, the offset pulleys are advantageously, but optionally, placed at counterbalancing orientations relative to the shaft 36 in order to avoid excessive oscillations, much like a camshaft in an internal combustion engine. In the depicted embodiment the end pulleys 26 are connected to the drive coupling 36 180° opposite the middle pulleys 26. Further, in the depicted embodiment, the distal end of the shaft 36 is rotatably held in bearing block 68. As needed, bearing blocks can be placed on the shaft 36 in between, or on opposing sides of, one or more offset pulleys 26 in order to provide stability and reduce vibration. In the illustrated embodiment a force generating device 32 is provided for each offset pulley and each engaging device 22. If desired, a single force generating device 32 could be coupled to more than one cable 24 in order to coordinate the user's exercise, as for example in rowing applications.

Figure 18:
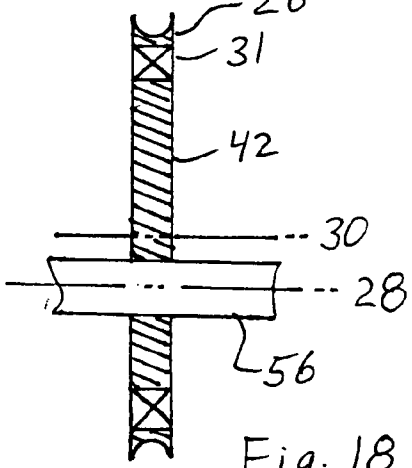
FIG. 18 is a partial sectional view taken along section 18-18 of FIG. 17.

An alternative construction of the offset pulley 26 is used in this embodiment that is best understood by referring to FIGS. 1-2 and 17-18. In the embodiment of FIGS. 1-2 as the pulley 26 rotates about axis 30, one or both ends of the cables 24 that wrap around the pulley cross the rotational axis 30 about which the pulley circles. If the motor drive shaft were to extend along this rotational axis 30 as shown in FIG. 17, then the cables 24 could wrap around the drive shaft. This can be avoided by making the offset pulley 26 have a diameter large enough to encircle the drive shaft along axis 30, or a drive surface 27 large enough and located to encircle axis 30, as shown in FIG. 18. In that Figure the drive coupling 36 comprises a drive shaft of the motor rotating along axis 30. The disk 42 is eccentrically mounted relative to the drive shaft 36 with the pulley 26 located on the outer periphery of the disk 42 and of large enough diameter so the pulley 26 and its peripheral drive surface 27 encircles the drive shaft, whereas the pulley of FIG. 1 circles around the drive shaft but does not encircle it. Relative motion between the disk 42 and pulley 26 is provided by bearing surface 31, which also encircles the drive axis 30. In the depicted configuration the pulley 26 is in the same plane as the disk 42, but the pulley 26 could be offset along the length of axis 30 as in the embodiment of FIG. 2.

The pulley 26 simultaneously rotates about two aligned or substantially parallel, but offset axes 28, 30. In the embodiment of FIG. 1 the disk 42 rotates about its central axis 30 and the pulley 26 is offset a distance d. In the embodiment of FIG. 1, the disk 42 is offset a distance d from the pulley axis 28.

Referring to FIG. 17 there is shown an alternative engaging device 22, in the form of a flexible cuff of adjustable size, which encircles a persons arm, leg, torso or forehead to allow further variations in exercising various body parts and muscle groups. Hook and loop fasteners, buckles or other releasable fasteners known to those skilled in the art can be used to releasably engage the desired body part and to adjust the size of the cuff as need.

FIG. 19 shows a further embodiment in which a resilient member 64 is fastened to a fastener 58 comprising an eye-bolt, which is in turn removably fastened to mounting bracket 54. The sizes are illustrative only, but the figure does illustrate an arrangement providing for vertical travel of the handle 22. Other orientations are possible, as is also the case with the other embodiments.

Figure 20:
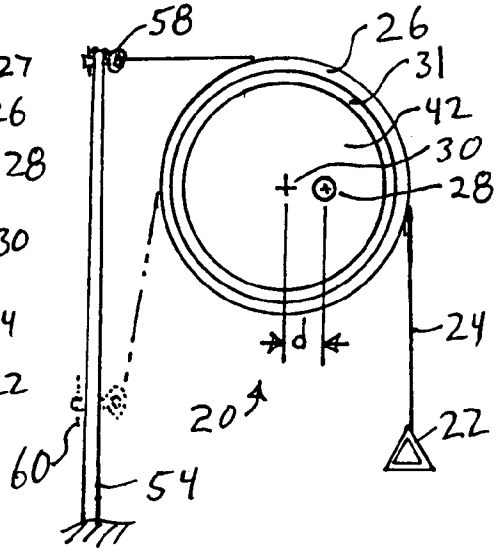
FIG. 20 is a plan view of a further embodiment of an exercise device of FIG. 1 especially suited for isometric exercise devices.

FIG. 20 is a further embodiment suitable for use as an isometric exercise device 20 using the offset pulley 26. The cable 24 is mounted to a mounting bracket 54 by fastener 58 that is in turn held in position by releasable lock 60.

Figure 21:
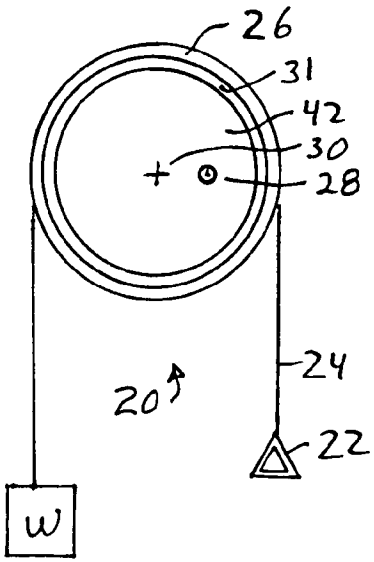
FIG. 21 is a plan view of a further embodiment of an exercise device of FIG. 1 especially suited for weight lifting exercise devices.

FIG. 21 is a further embodiment in which the cable 24 wraps around the eccentric pulley 26 with a weight W at one end of the cable and the handle 22 at the other end.

Figure 22:
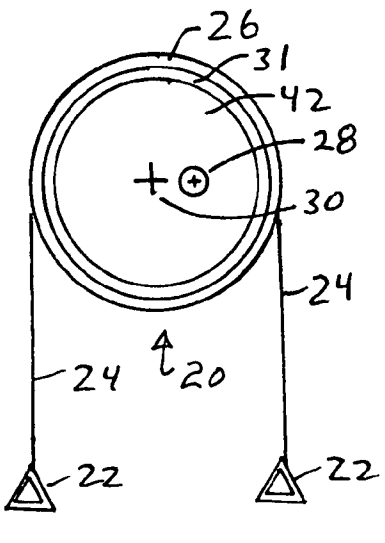
FIG. 22 is a plan view of a further embodiment of an exercise device of FIG. 1 especially suited for bilateral exercise devices.

FIG. 22 is a bilateral exercise device 20 with handles 22 on each distal end of the cable 24, with the cable wrapping around the offset pulley 26.

The embodiments of FIGS. 19-22 are particularly suitable for physical therapy and rehabilitation, as the forces and vibration on the handle 22 can be small. Further, in the embodiments of FIGS. 20-22 the motor 34 and pulley 26 rotate about offset axis 28, and in the embodiment of FIG. 19 the motor causes rotation about axis 30 with the pulley 26 rotating about axis 28. The various arrangements of the axes of rotation 28, 30 can be used with the various embodiments except as noted herein when some of the cables may wrap around the drive coupling 36.

Figure 23:
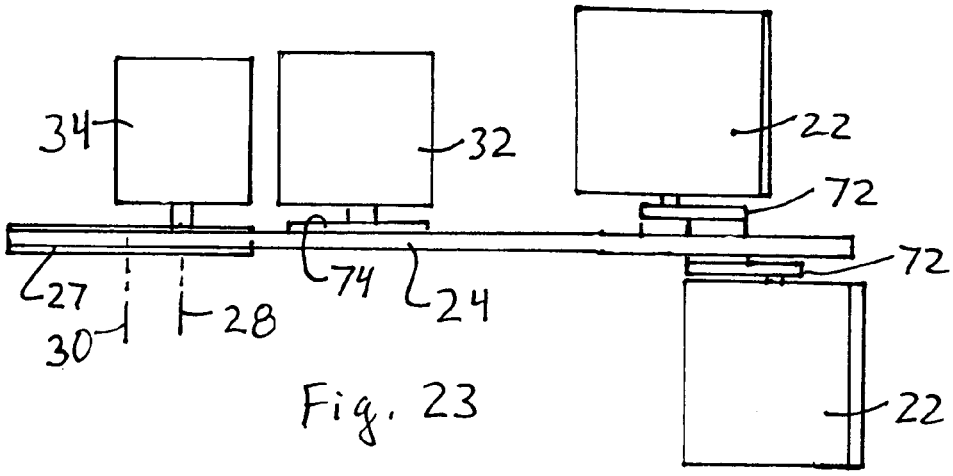
FIG. 23 is a plan top view of the exercise device of FIG. 24.
Figure 24:
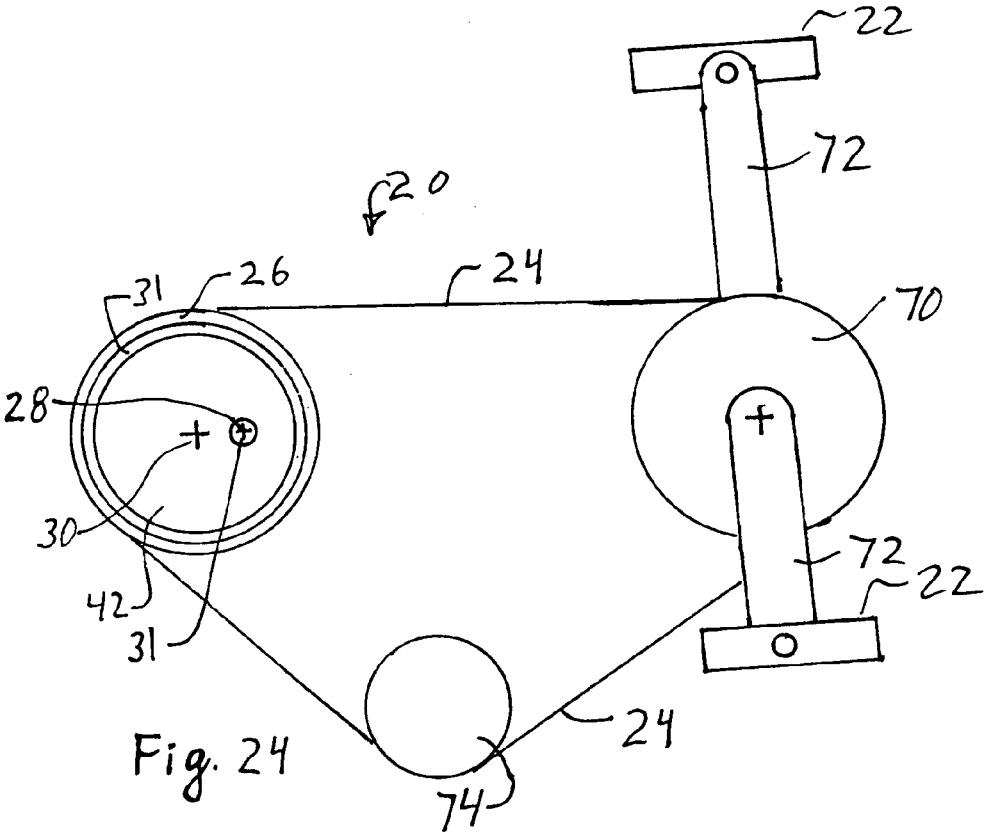
FIG. 24 is a plan side view of a further embodiment of an exercise device of FIG. 1 showing a rotary, crank exercise device.

Referring to FIGS. 23-24, a further rotary embodiment is shown in which the flexible tension member 24 takes the form of continuous loop, preferably formed by a chain or drive belt that winds around the curved cycloid driving surface 27 of a sprocket 70 connected to two opposing offset cranks 72 having user engaging devices 22 taking the form of handles or pedals, depending on whether the crank is to be turned by hand or by foot. A force generating device 32 is also in driving communication with the chain through a sprocket 74. The offset pulley 26 provides a vibration to the chain 24 and the force of resistance to rotation of crank 72 is provided by the variable resistance device 32.

In a further variation of this embodiment the motor 32 could not drive sprocket 74 and instead could be connected to drive the sprocket 70 by use of a chain or pulley different from the flexible tension member 24. Alternatively, the sprocket 74 could be an idler sprocket, or the sprocket 74 could be resiliently mounted to take up any slack in the tension member 24 and thus maintain the tension member at a desired tightness. Further, the motor 32 and its driven sprocket 74 could both be resiliently mounted (e.g., spring mounted) to take up any slack in the tension member 24 and thus maintain the tension member at a desired tightness.

Figure 25:
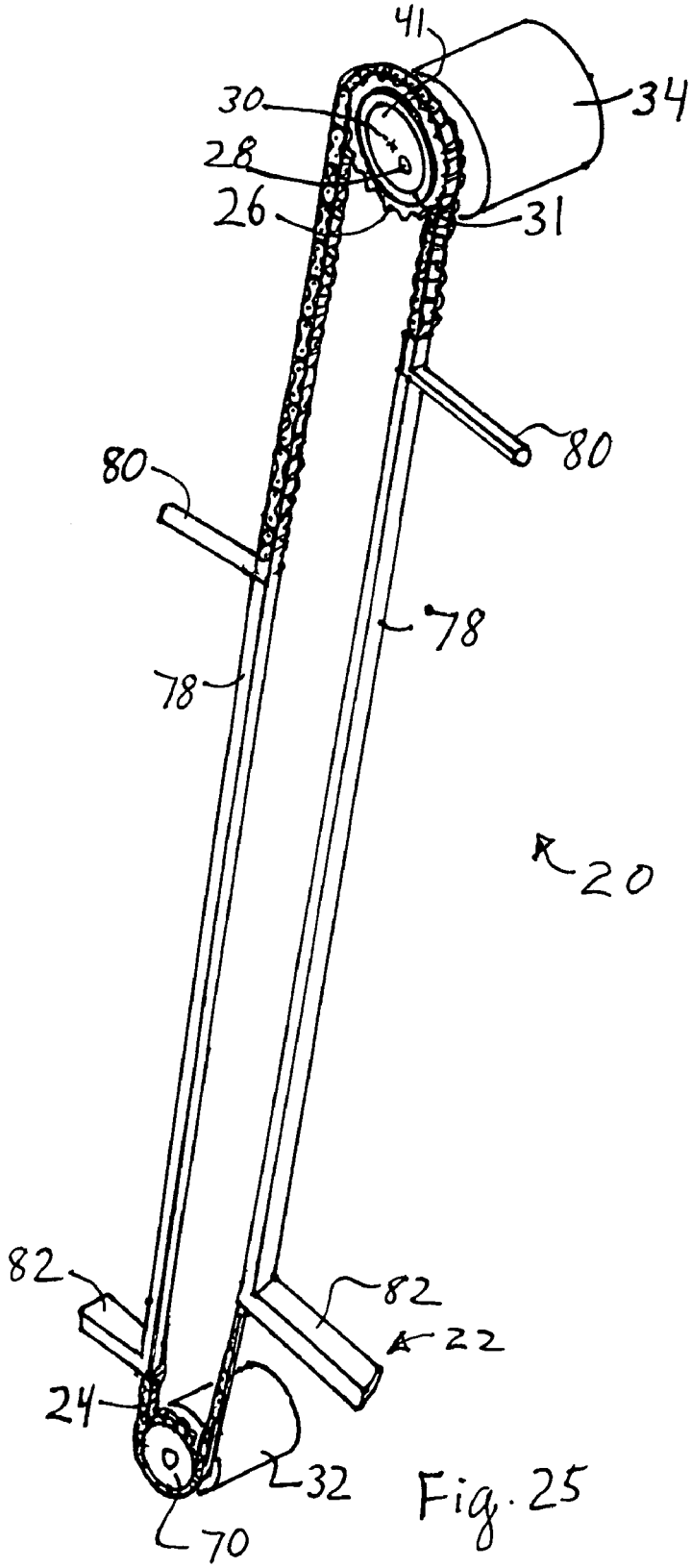
FIG. 25 is a partial perspective view of a further embodiment of an exercise device of FIG. 1 especially suited for a climbing or total body climbing exercise device.

Referring to FIG. 25, a climbing or total body exercise embodiment is shown in which the oscillating surface 26 comprises a sprocket drive 26, preferably, but optionally, having the construction of FIG. 18 with bearing 31 on the periphery of disk 42, and the motor 34 driving disk 42 about axis 28 which is offset from the geometric center of the sprocket axis 30. The chain 24 engages the driving surface 27 of sprocket 26, and has bars 78 connected to opposing distal ends of the chain 24. The bars 78 advantageously, but optionally comprise elongated members, preferably of metal, which have a hand grip 80 extending from the upper end of each bar 78, and which have a foot rest 82 extending from the lower end of each bar 78. The hand grip 80 and foot rest 82 are specific forms of the user engaging device 22. The lower end of each bar 78 is connected to a chain 24 which wraps around a second, opposing lower sprocket 70. The bars 24 and chains 26 form a continuous loop around opposing upper and lower sprockets 26, 70.

The bars 78 are optional and could be replaced by chain or cable with the foot and hand engaging portions 80, 82 being clamped or otherwise fastened to the chain or cable. Such a device is shown in U.S. Pat. No. 5,040,785, the complete contents of which are incorporated herein by reference. Further, the sprocket 70 could be an idler/take-up sprocket or pulley, and the sprocket could be further optionally spring loaded to maintain the flexible tension member 24 in tension.

Rotation of offset sprocket 26 by motor 34 which is drivingly connected to the sprocket 26 causes the chain 24 to vibrate, and thus causes the bars 78 and attached hand grips 80 and foot rests 82 to vibrate. The lower sprocket 70 can be connected to a force generating device 32 to exert resistance to movement of the chain 26 and bars 78. Various configurations for frames and supports for the moving parts and reciprocating parts (e.g., bars 78) can be provided. The force generating device 32 preferably, but optionally comprises a hydraulic motor with a pinch valve to adjust the speed. A more detailed description of a climbing or total body climbing exercise device 20, without the vibration caused by offset sprocket 26, is described in U.S. Pat. Nos. 5,040,785 and 5,679,100, the complete contents of which are incorporated herein by reference.

The offset oscillating surface 26 thus advantageously provides rotational means for causing a back and forth movement, oscillation or vibration on flexible tension member 24 or on a non-flexible member such as bar 78. The user engaging device 22 provides means by which a user can engage the flexible tension member 24. This oscillation can be applied to reciprocating or rotating exercise devices, and to other exercise devices as well.

There is also advantageously provided a method of causing an oscillation in flexible tension member 24, or in a non-flexible member such as bar 78. The method rotates an oscillating surface 26 having a curved engaging surface 27, preferably circular, about an offset rotational axis 28, with a flexible tension member 24 wrapped around the driving surface 27 extending around art least a portion of the periphery of the oscillating surface 26. The rotation of the oscillating surface 26 about its own axis reduces wear between the contacting portions of the oscillating surface 26 and the flexible tension member 24.

There is also a method for providing exercise to a user of an exercising device 20 having a flexible tension member 24 connected to a user interface 22 (which also includes 80, 82) that is connected to a mechanism for generating a resistive force 32 which is overcome by the user to obtain exercise. The method includes rotating a first part about a first axis and rotating a circular surface about the first axis and about a second axis 28, 30 through the center of the circular surface. The first and second axes are offset by a distance d. The method also includes wrapping the flexible member 24 around part of the circular surface and moving the flexible member along that circular surface. The method also includes rotating the circular surface about the second axis as the circular surface rotates around the first axis during use of the exercise device to cause oscillatory motion in the flexible tension member 24.

The motor 34 can comprise an electric motor, a hydraulic motor, a pneumatic motor, or any other type of motor suitable for use on an exercise device 20 and configured to rotate the oscillating surface 26. A reciprocating linear motor connected to an offset cam (as in a wheel-driven steam locomotive) would also comprise a suitable motor.

The motor 34 advantageously rotates the pulley 26 at speeds of from 0 to about 80 Hz, although any desired speed could be used. There are believed to be disadvantages if rotational speeds of the pulley 26 5o exceed 100 Hz, as some literature indicates such vibrational speeds may have undesirable effects on the users. But there are no limits to the rotational speed other than what the motor and physical parts impose on the rotational speed.

Figure 26:
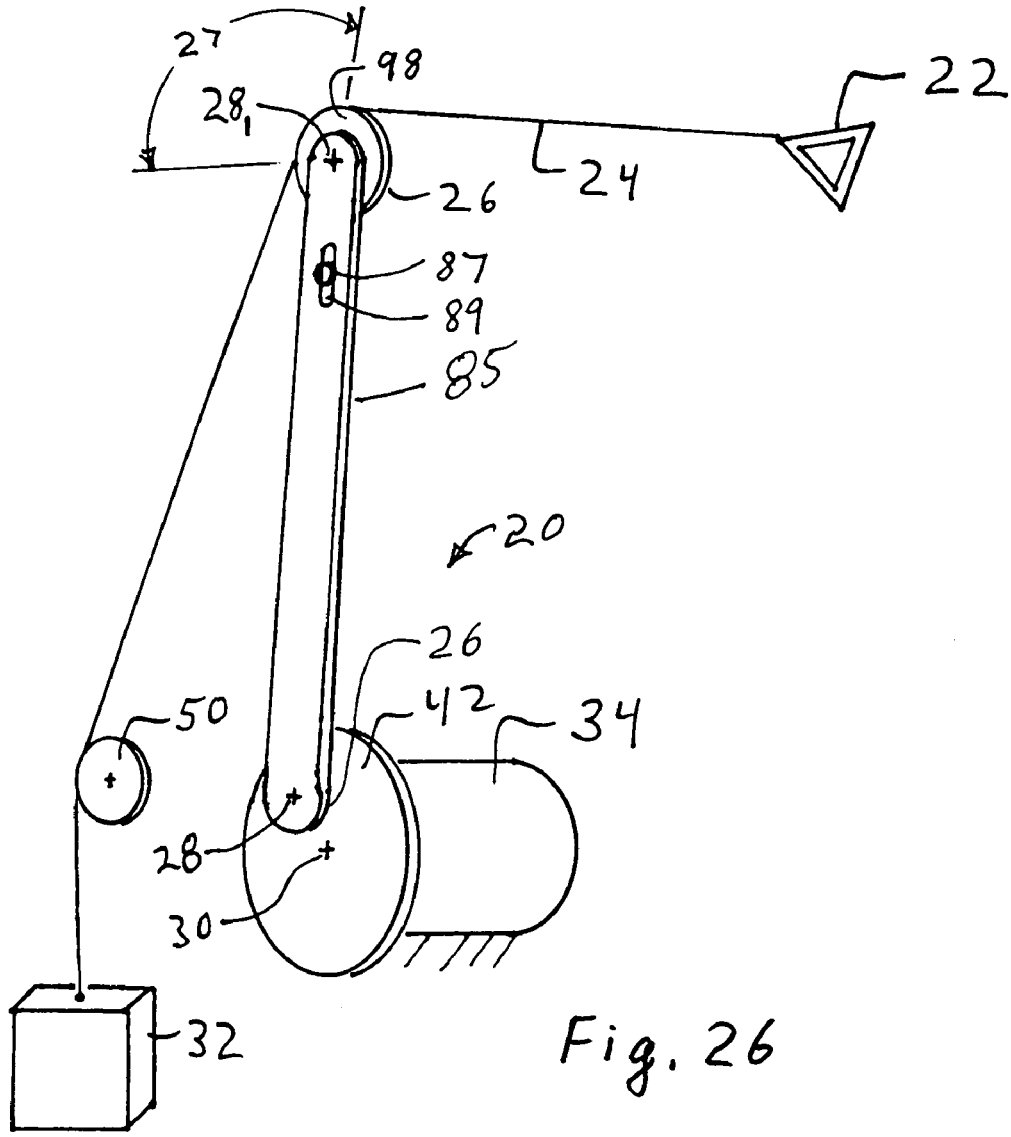
FIG. 26 is a further embodiment having a rigid extension to offset the rotating surface on the pulley.

Referring to FIG. 26, a further embodiment is shown having a member that is stiff not only along its longitudinal axis but also stiff laterally, such as an elongated member 85. The member 85 extends between the axis 28 and the pulley 98 (FIG. 26). One end of the member 85 is rotatably mounted to disk 42 to rotate about axis 28 and essentially form the offset surface 26. An opposing end of the member 85 is fastened to a pulley 98 which rotates about offset axis $\mathbf{28}_1$ located on the elongated member 85 and substantially parallel to but offset from axis 28. The pulley 98 corresponds to but is offset from oscillating surface 26 and can comprise a sprocket or other corresponding part. But the flexible tension member 24 engages the pulley 98 instead of the oscillating surface 26, with the elongated member 85 translating the motion of the oscillating surface 26 to the pulley 98. In addition to translating the motion to the pulley 98, the member 85 can optionally modify the motion of the oscillating surface 26 that is transferred to the pulley 98.

Depending on the mounting of the member 85, the motion of the oscillating pulley 98 about offset axis $\mathbf{28}_1$ can be the same as, larger than or smaller than the rotation about axis 28. The member 85 can be mounted various ways, but is shown as having an elongated slot 89 extends through the member 85 and aligned with the length of the member 85. A stationary, headed pin 87 extends through the slot to allow the member 85 to reciprocate along its length while rotating about the pin 87. As the end of member 85 fastened to disk 42 rotates about axes 28, 30, the member 85 reciprocates along the longitudinal axis of the member 85 and rotates about pin 87. While axis 28 circles around axis 30, the axis $\mathbf{28}_1$ of pulley 98 does not actually do so. Nevertheless, the pulley 98 does move or oscillate in direct correspondence with the rotation of the end of the elongated member 85 that is connected to rotate about the axis 28. The member 85 could be replaced by a continuous tension member such as a chain or belt in order to transmit the oscillatory motion from motor 34 and axes 28, 30 to the remotely located pulley 98.

The motion of pulley 98 about axis $\mathbf{28}_1$ is variable. As the slot 89 and pin 87 approach the oscillating pulley 26 the motion of the pulley 98 decreases relative to the motion of the end of the member 85 fastened to disk 42. As the slot 89 and pin 87 approach the disk 42 the motion of the pulley 98 increases relative to the motion of the end of the member 85 fastened to disk 42.

The member 85 can be viewed as translating the motion about axis 28 to motion about axis $\mathbf{28}_1$, with or without amplification or reduction. Alternatively, it can be viewed as offsetting the location of pulley or oscillating surface 26, and allowing for varying the magnitude of the motion of the oscillating surface 26. There is thus provided a means for varying the amplitude of motion of the oscillating surface 26 relative to the rotation about axis 30. There is also provided a means for offsetting the rotation of the oscillating surface 26 from that of the disk 42 and from the axis 30.

Varying the location and orientation of the idler pulley or pulleys 50 and the oscillating pulley 98, a user can vary the amount of cable 24 wrapped around the pulley 98. There is thus also provided a further means for varying the amplitude of the oscillation in cable 24.

Figure 27:
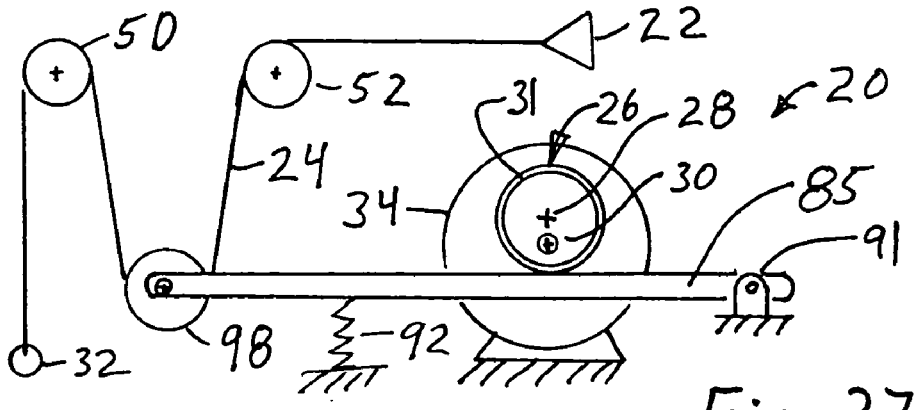
FIG. 27 is a further embodiment having a rigid extension to offset the oscillating effect of the oscillating pulley.

Referring to FIG. 27 a further embodiment is shown in which the oscillating surface 26 abuts an elongated member 85 having one end rotatably mounted at pivot point 91, and having a pulley 98 on an opposing end of the member 85. In this embodiment the bearing 31 can optionally comprise the exterior of the oscillating surface 26, or the bearing could be further radially inward with an exterior surface comprising the oscillating surface 26. As the oscillating surface 26 oscillates the elongated member 85 is periodically urged against the resilient member 92 to oscillate the pulley 98. The resilient member 92 maintains the elongated member 85 in contact with the oscillating surface 26. As in the embodiment of FIG. 26, by varying the location of the contact with oscillating surface 26 along the length of the elongated member 85, the oscillation of the pulley 98 can be increased or decreased. The member 85 could comprise a leaf spring so the pivot point 91 coincides with the location of at least a portion of the spring 92.

Other mounting arrangements are known to one skilled in the art devised given the present disclosure. In the above embodiments the oscillating surface 26 is shown as having a circular periphery such as a pulley or a sprocket.

Figure 28:
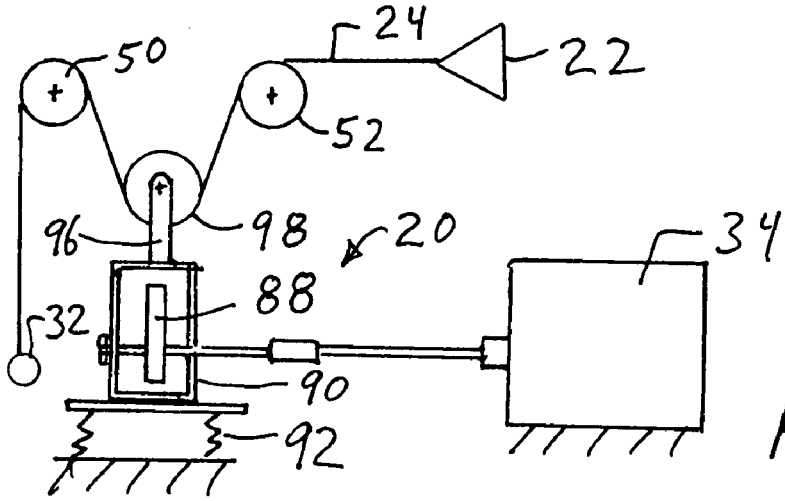
FIG. 28 is a further embodiment of a vibrating pulley exercise device.

The embodiments of FIGS. 27-28 show mechanisms by which the oscillatory motion of the surface 26 can be used without wrapping a flexible tension member around the surface 26. Those embodiments use a laterally stiff member 85 and exert bending forces on that member 85.

Referring to FIG. 28 is preferably located on a rotating part and a further vibrational device is shown, but one that allows linear vibration without any rotation. A motor 34 has a flexible drive shaft 86 which rotates an eccentric or offset weight 88 that is rotatably mounted in a frame 90. The frame 90 in turn is resiliently mounted by resilient mounting members 92 so that rotation of the offset weight 88 by motor 34 causes the frame to vibrate on the resilient mounting members 92. The resilient mounting members can comprise springs, or resilient materials. The frame 90 is connected to a pulley 98 by connecting bracket 96. The pulley 98 corresponds to pulley 26 but it is not offset, but the vibration of frame 90 is usually constrained to move only linearly along the length of bracket 96 and along the resilient axis of the resilient mounting members 92 instead of rotary oscillation as commonly occurs with pulley 26. Thus, rotation of the offset weight 88 causes vibration of the pulley 98. The motor 34 is not mounted on the resilient mount members 92 so the flexible shaft 86 allows for the difference in movement that will occur between the motor 34 and the driven weight 88.

A flexible tension member 24 such as a cable or rope wraps part way around the periphery of the pulley 98. One end of the tension member 24 is connected to the user interface 22, such as a handle. The other end of the tension member 24 wraps around an idler pulley 50 and then fastens to a force generating mechanism, which is shown in the illustration as a weight W. Different arrangements could be used to connect to the force generating mechanism 32 and to the user interface 22.

Figure 29:
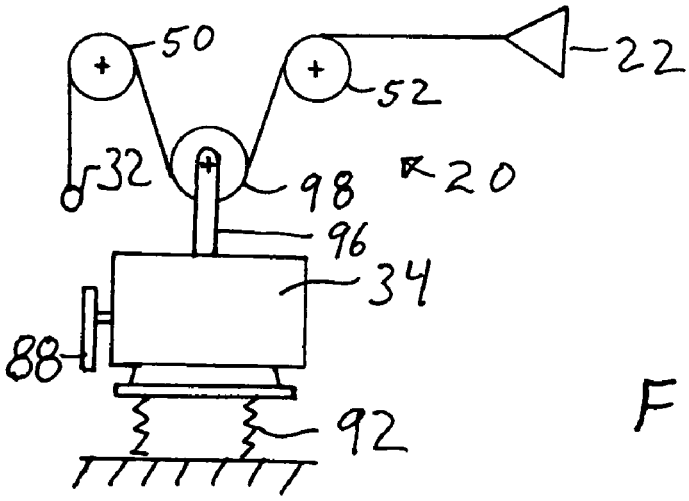
FIG. 29 is a further embodiment of a vibrating pulley exercise device.

Referring to FIG. 29, a still further embodiment is shown for vibrating a pulley. In this embodiment the motor 34 again rotatably drives eccentric weight 88. But in this embodiment the motor 34 is mounted on the resilient mounting members so that it vibrates with the eccentric weight 88. A shorter motor shaft is provided, and the weight 88 is cantilevered off the shaft. A double cantilever mount could be used as in FIG. 28, and if so the frame holding the double cantilever is also mounted on the resilient mounting members 92. The pulley 98 can be fastened directly to the motor 34, or to a frame (not shown) to which the motor is also connected.

Rotation of the eccentric weight 88 causes the pulley 98 to vibrate or oscillate, typically along a single axis with which the resilient mounting members 92 are aligned. The tension member 24 is connected to the handle 22 and weight 32 as in the prior embodiment so the vibration is experienced by the user. Thus, this embodiment is like that of FIG. 28 except the motor is also resiliently mounted and vibrates along with the weight 88 and pulley 98.

The motor 34 and various other parts are mounted to a frame which is not shown. The frame can take a variety of shapes and configurations to place the resistance device 22 is at a location suitable for the particular exercise use desired by the user. The motor 34 is preferably mounted to the support frame using a mounting that dampens vibration and/or isolates the vibration of the motor 34 from the frame. Rubber or polymer isolation mounts are believed advantageous. Energy absorbing mounts are believed advantageous which provide a dashpot effect. Flexible drive shafts could be used. Similar isolation or vibration absorbing mountings could advantageously, but optionally be used on any pulley 98 which moves with offset motion. The motor 34 could be mounted off the frame, but adjacent thereto to provide a physical separation.

The oscillation caused by the use of offset rotational axis 28, 30 is preferably transmitted only along the length of the flexible tension member 24. Preferably the frame to which the user interface 22, various pulleys 50, 52, the oscillating surface 27, and motor 34 are fastened does not perceptibly vibrate when touched by the user. All the oscillatory motion is preferably directed only into the flexible tension member 24 and the user interface 22. That is difficult to achieve in practice. Using vibration isolation devices and dampening devices on the appropriate mounting of the oscillating parts to the frame helps reduce vibration of the frame. Thus, resilient mounting of the oscillating parts, especially using vibration damping materials and mounts, is preferred. Similarly, resilient, and dampened mounting of the parts engaging the flexible tension member is also desirable. The use of rubber or polymer mounting grommets on the devices that contact the flexible tension member are believed suitable. Thus, preferably all or many of the parts which oscillate and guide the flexible tension member 24 are mounted in vibration isolating and dampening devices, such as rubber mounts. The frame itself is also advantageously provided with rubber feet or mounting pads between the frame and the floor on which the exercise device typically rests.

Further, suitable motion guides need to be provided not only to guide the movement of the flexible tension member and exercise interface 22, but motion restraints may be needed at various locations where lateral movement of the tension member 24 or bar 78 becomes excessive and hits the frame and imparts vibration and noise. Low friction guides are desired so the resistance generating device 32 can predictably control the exercise resistance on user interface 22 (which includes 80, 82). Plastic guides on one or more sides (preferably opposing sides) of the flexible tension member 24 are believed suitable, but other material could be used as appropriate for the particular design.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The above description is given by way of example, and not limitation. Given the above disclosure, one skilled in the art could devise variations that are within the scope and spirit of the invention, including various ways of arranging the pulleys and sprockets and other forms of the oscillating surface 26. Further, the various features of this invention can be used alone, or in varying combinations with each other and are not intended to be limited to the specific combination described herein, especially as to the various pulleys and sprockets 26, and handles 22, and tension members 24. Thus, the invention is not to be limited by the illustrated embodiments but is to be defined by the following claims when read in the broadest reasonable manner to preserve the validity of the claims.

What is claimed is:

1. An exercising device for a user, the exercise device having a flexible tension member connected to a user interface that is connected to a mechanism for generating a resistive force which is overcome by the user moving the user interface to obtain exercise, comprising:

a circular oscillating surface circling about a first axis and rotating about a second axis substantially parallel to the first axis, the second axis passing through a center of the oscillating surface, a structure rotating about the first axis and connected to the oscillating surface to constrain the oscillating surface to circle about the first axis, the first and second axes being offset a distance d, the flexible member wrapping at least part way around the circular oscillating surface to rotate the oscillating surface about the second axis as the user interface moves during use of the exercise device.

2. The exercising device of claim 1, wherein the oscillating surface comprises a sprocket.

3. The exercising device of claim 1, wherein the oscillating surface comprises a disk and the oscillating surface comprises a pulley.

4. The exercising device of claim 1, wherein the oscillating surface comprises a sprocket and the flexible tension member comprises a chain.

5. The exercising device of claim 1, wherein the circular oscillating surface encircles the first axis.

6. The exercising device of claim 1, wherein the circular oscillating surface encircles the first axis and further comprising a bearing interposed between the oscillating surface and the axis about which the oscillating surface rotates.

7. The exercising device of claim 1, wherein the oscillating surface comprises a sprocket and the flexible tension member has opposing ends each connected to a first end of a bar, the bar having a user interface thereon.

8. The exercising device of claim 1, wherein the oscillating surface comprises a sprocket and the flexible tension member has at least one foot rest and at least one hand grip fastened thereto.

9. The exercising device of claim 8, wherein the motor rotates the oscillating surface at a speed of below about 100 Hz.

10. The exercising device of claim 1, wherein the flexible tension member forms a continuous loop having two parallel members each of which has a foot rest and a hand grip fastened thereto.

11. The exercising device of claim 1, wherein the resistive device comprises at least one weight urged by gravity to apply the resistive force to the flexible tension member.

12. The exercising device of claim 1, wherein the resistive mechanism comprises a hydraulic motor.

13. The exercising device of claim 1, wherein the resistive mechanism comprises a spring.

14. The exercising device of claim 1, further comprising at least two pulleys with the flexible tension member wrapping at least part way around each pulley.

15. The exercising device of claim 1, wherein the flexible tension member is connected to a releasable fastener which can be inserted into one of a plurality of apertures to vary the amount the flexible member wraps around the circular surface.

16. The exercising device of claim 1, further comprising means for varying the amount the flexible member wraps around the circular surface.

17. The exercising device of claim 1, wherein the first axis comprises an axle and there are a plurality of oscillating surfaces each of which comprises a disk connected to the axle to rotate with the axle, each oscillating surface engaging a separate flexible tension member in communication with a user interface.

18. The exercising device of claim 1, wherein the distance d is less than about 0.5 inches.

19. The exercising device of claim 1, further comprising a resilient member interposed between the flexible tension member and the user interface.

20. The exercising device of claim 1, further comprising a one of a vibration isolator or damper interposed between the motor and a frame of the exercise device to reduce vibration of the frame.

21. An exercising device for a user, the exercise device having a user interface connected to a mechanism for generating a resistive force which is overcome by the user moving the user interface to obtain exercise, comprising:

a motor;

a rotating part driven by the motor to rotate about a first drive axis;

a circular oscillating surface rotatably mounted to the rotating part and having a second axis passing through the center of the circular oscillating surface and offset from the first drive axis by a distance d and;

a flexible tension member having a first end connected to the resistive force mechanism and a second end connected to the user interface, the tension member wrapping at least partway around the oscillating surface to rotate the oscillating surface as the user interface moves during use of the exercise device.

22. The exercising device of claim 21, wherein the motor rotates the oscillating surface at a speed of below about 100 Hz.

23. The exercising device of claim 21, further comprising a laterally stiff elongated member having one end rotatably mounted about the second axis and having the circular oscillating surface rotatably mounted at an opposing end.

24. The exercising device of claim 21, wherein the distance d is less than about 0.5 inches.

25. The exercising device of claim 21, wherein the motor is a variable speed motor.

26. The exercising device of claim 21, wherein the distance d is about 0.1-0.3 inches and the oscillating surface rotates about the first axis at about 100 Hz or less.

27. The exercising device of claim 21, wherein the oscillating surface encircles the first axis.

28. The exercising device of claim 21, wherein the oscillating surface comprises a pulley rotating about the second axis.

29. The exercising device of claim 21, wherein the flexible tension member forms a continuous loop.

30. The exercising device of claim 29, further comprising a resiliently mounted tension pulley in contact with the continuous loop to maintain tension in the loop.

31. The exercising device of claim 21, wherein a resilient member is interposed between the user interface and the oscillating surface.

32. The exercising device of claim 21, wherein the flexible member is formed in a continuous loop and interfaces with a rotating user interface.

33. The exercising device of claim 21, wherein the user interface reciprocates.

34. The exercising device of claim 21, wherein the oscillating surface comprises a sprocket and the flexible tension member has opposing ends each connected to a first end of a bar, the bar having a user interface thereon.

35. The exercising device of claim 21, wherein the oscillating surface comprises a sprocket and the flexible tension member has at least one foot rest and at least one hand grip fastened thereto.

36. The exercising device of claim 21, wherein the flexible tension member forms a continuous loop having two parallel members each of which has a foot rest and a hand grip fastened thereto.

37. The exercising device of claim 36, wherein the motor rotates the oscillating surface at a speed of below about 100 Hz.

38. An exercising device for a user, the exercise device having a user interface connected to a mechanism for generating a resistive force which is overcome by the user moving the user interface to obtain exercise, comprising:

means for rotating a circular oscillating surface about two substantially parallel axes which are offset a distance d;

a flexible tension member having a first end connected to the resistive force mechanism and a second end connected to the user interface, the flexible tension member wrapping partway around the oscillating surface to rotate the oscillating surface about one of the axes during use of the exercise device.

39. The exercising device of claim 38, further comprising means for varying the amount the flexible member wraps around the circular oscillating surface.

40. The exercising device of claim 38, further comprising means for varying the distance d.

41. The exercising device of claim 38, wherein the oscillating surface encircles the first axis while rotating about the second axis which passes through the center of the circular surface.

42. The exercising device of claim 38, wherein the oscillating surface comprises a sprocket and the flexible tension member has opposing ends each connected to a first end of a bar, the bar having a user interface thereon.

43. The exercising device of claim 38, wherein the oscillating surface comprises a sprocket and the flexible tension member has at least one foot rest and at least one hand grip fastened thereto.

44. The exercising device of claim 38, wherein the flexible tension member forms a continuous loop having a foot rest and a hand grip fastened thereto.

45. The exercising device of claim 44, wherein the motor rotates the oscillating surface at a speed of below about 100 Hz.

46. A method for providing exercise to a user of an exercising device having a flexible tension member connected to a user interface that is connected to a mechanism for generating a resistive force which is overcome by the user to obtain exercise, comprising:

rotating a first part about a first axis;

rotating a circular surface about the first axis and about a second axis through the center of the circular surface, the first and second axis offset by a distance d;

wrapping the flexible member around part of the circular surface;

moving the flexible member along that circular surface and rotating the circular surface about the second axis as the circular surface rotates around the first axis during use of the exercise device to cause oscillatory motion in the flexible tension member.

47. The method of claim 46, further comprising rotating the first part at about 100 Hz or less during use.

48. The method of claim 46, further comprising offsetting the first and second axes a distance d of about 0.1 to 0.3 inches.

49. The method of claim 46, wherein the circular surface comprises a sprocket and the flexible member is a chain.

50. The method of claim 46, further comprising rotating the first part at about 100 Hz or less during use of the exercise device.

51. The method of claim 46, wherein the circular surface comprises a pulley.

52. The method of claim 46, wherein the circular surface comprises a sprocket.

53. The method of claim 46, wherein the rotation of the first part occurs at a speed that is adjusted by the user.

54. The method of claim 46, further comprising forming the flexible tension member in a continuous loop and connecting it to a rotating user interface.

55. The method of claim 54, further comprising placing a tension pulley in engagement with the continuous loop.

56. The method of claim 46, further comprising forming the flexible tension member in a continuous loop and connecting it to a reciprocating user interface.

57. The method of claim 46, further comprising forming the circular surface so it encircles the first axis.

58. The method of claim 46, further comprising varying the amount that the flexible member wraps around the circular surface to wrap less than half a circumference of the circular surface.

59. The method of claim 46, further comprising varying the amount of offset d.

60. The method of claim 46, further comprising locating the curved surface between two pulleys each of which engages the flexible member.

61. The exercising device of claim 46, wherein the circular surface comprises a sprocket and the flexible member has opposing ends each connected to a first end of a bar, each bar having a user interface thereon.

62. The exercising device of claim 46, wherein the circular surface comprises a sprocket and the flexible member has at least one foot rest and at least one hand grip fastened thereto to form the user interface.

63. The exercising device of claim 46, wherein the flexible tension member forms a continuous loop having a foot rest and a hand grip fastened thereto.

64. The exercising device of claim 63, wherein the motor rotates the oscillating surface at a speed of below about 100 Hz.

65. The exercising device of claim 63, further comprising interposing one of a vibration isolator or damper between the rotating circular surface and a frame of the exercise device to reduce vibration of the frame.

66. The exercising device of claim 63, further comprising mounting the parts which oscillate and guide the flexible tension member, in vibration isolating and dampening devices.

* * * * *